US006866381B2

(12) United States Patent
Kelly-Rowley et al.

(10) Patent No.: US 6,866,381 B2
(45) Date of Patent: Mar. 15, 2005

(54) AUXILIARY FLUIDS WHICH GIVE IMPROVED PRINT PERMANENCE

(75) Inventors: Anne M. Kelly-Rowley, San Diego, CA (US); Melissa D. Lee, Escondido, CA (US); Amiya K Chatterjee, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 133 days.

(21) Appl. No.: 10/261,721

(22) Filed: Sep. 30, 2002

(65) Prior Publication Data

US 2004/0061756 A1 Apr. 1, 2004

(51) Int. Cl.[7] ..... B41J 2/01
(52) U.S. Cl. ..... 347/101; 347/105; 347/100
(58) Field of Search ..... 347/100, 101, 347/105, 96; 428/195, 32.1

(56) References Cited

U.S. PATENT DOCUMENTS 4,538,160 A 8/1985 Uchiyama
4,649,064 A * 3/1987 Jones ..... 347/100
4,694,302 A 9/1987 Hackleman et al.
5,549,740 A 8/1996 Takahashi et al.
6,060,541 A 5/2000 Anderson et al.
6,254,230 B1 * 7/2001 Wen et al. ..... 347/101
6,270,214 B1 * 8/2001 Smith et al. ..... 347/101
6,312,858 B1 11/2001 Yacobucci et al.
6,412,935 B1 7/2002 Doumaux
6,565,949 B1 * 5/2003 Wang et al. ..... 428/32.24

FOREIGN PATENT DOCUMENTS

EP 1228889 A2 8/2002
WO WO 00/63024 10/2000

* cited by examiner

*Primary Examiner*—Manish Shah

(57) ABSTRACT

Smear resistant ink jet ink images and methods for making such are disclosed and described. Generally, a smear resistant ink jet ink image includes an ink jet ink image upon a print substrate, and a water insoluble protective film having contact with the ink jet ink in the image. In one aspect, the film may include a combination of water soluble film forming polymers that become water insoluble upon interaction with one another. In another aspect, the water soluble film forming polymers may be interacted at the print substrate to form the water insoluble film.

65 Claims, 1 Drawing Sheet

AUXILIARY FLUIDS WHICH GIVE IMPROVED PRINT PERMANENCE

FIELD OF THE INVENTION

The present invention provides auxiliary fluids that together with ink jet ink compositions produce ink jet ink images having significant wet smear resistance and high quality visual characteristics. Accordingly, the present invention involves the fields of chemistry, physics, and materials science.

BACKGROUND

A continual goal of ink jet printing is the achievement of printed images having improved visual quality. As is known in the art, a number of specific criteria dictate the visual quality of an image, such as chroma, optical density, and edge acuity. Overall image quality is determined by the permanence of such visual characteristics over time, and in view of various environment-imposed stress. Examples of image permanence characteristics include the ability of an image to resist fading upon exposure to light and atmospheric gasses and pollutants, (i.e. light fastness and air fastness), as well as the ability to resist damage upon exposure to humidity (waterfastness) or mechanical abrasion (i.e. smear resistance). Moreover, image resistance to physical abrasion is an important indicator of image permanence.

In addition to the above-recited image quality characteristics, an ink composition must meet a number of other criteria in order for the ink composition to be suitable for use as an ink jet ink. For example, the ink must not clog the ink jet printer nozzles, which have tight tolerances, typically 30 to 40 um in diameter. Further, the ink must not create a buildup of residue on the resistor elements that are responsible for firing the ink out of the nozzles. Such resistor elements are typically subjected to several hundred million firings over the life of an ink cartridge, and fouling of the resistor elements by a build up of ink residue, known as kogation, degrades pen performance and reduces the commercial life and value of the resistor.

The improvement of various aspects of ink jet ink compositions is a continually ongoing effort. Two attributes affecting permanence and image quality that have recently received significant attention are water fastness and smear resistance. This focus is especially pertinent for certain printing applications that must endure a higher risk of exposure to moisture and physical abrasion, such a bar code and photo quality printing.

To this end, a number of attempts have been made to improve the waterfastness, and smear resistance of a printed ink jet image. Various compositions and mechanisms that purport to increase the permanence of a printed ink jet image are known. However, most of these mechanisms and compositions contain one or more significant drawbacks, such as the requirement for special print media, various ingredient combinations that reduce ink jet pen reliability, and chemicals that are hazardous to human health, which require the use of a warning label and special shipping and handling conditions.

As a result, ink compositions and imaging methods that provide a highly water fast and smear resistant image, in a safe and consistent manner, without compromising the image's initial visual qualities, and which meet the performance criteria for use in an ink jet printer, continue to be sought through ongoing research and development efforts.

SUMMARY OF THE INVENTION

Accordingly, the present invention provides a smear resistant ink jet image on a print substrate. Generally, such an image includes images made with an ink jet ink, and a water insoluble protective film having contact with the ink jet ink in the image. The film generally includes a combination of water soluble film forming polymers that become water insoluble upon interaction with one another.

The present invention additionally provides a method of improving smear resistance of an ink jet image on a print substrate. Typically, such a method includes interacting a plurality of water soluble film forming polymers at the print substrate to form a water insoluble polymeric protective coating having contact with the ink jet ink in the image.

There has thus been outlined, rather broadly, various features of the invention so that the detailed description thereof that follows may be better understood, and so that the present contribution to the art may be better appreciated. Other features of the present invention will become clearer from the following detailed description of the invention, taken with the accompanying claims, or may be learned by the practice of the invention.

DETAILED DESCRIPTION OF THE INVENTION

Figure 1:
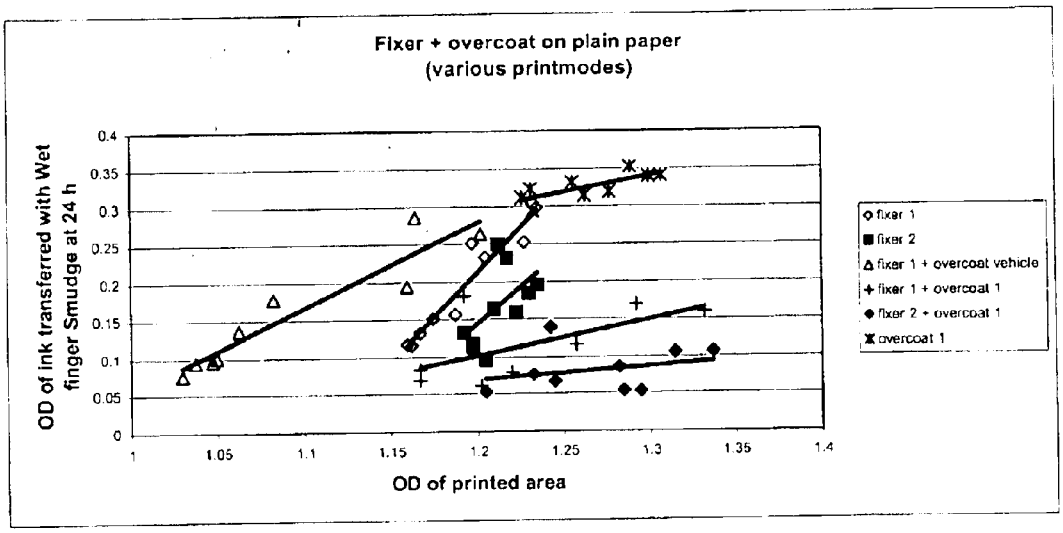
FIG. 1 shows a graphical representation of the smear resistance testing results for various images made in accordance with embodiments of the present invention as compared with a number of control images.

Before the present inkjet ink composition and method of making are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

Definitions

In describing and claiming the present invention, the following terminology will be used.

The singular forms "a," "an," and, "the" include plural referents unless the context clearly dictates otherwise. Thus, for example, reference to "a dye" includes reference to one or more of such dyes, reference to "an ink" includes reference to one or more of such inks, and reference to "the color" includes reference to a mixture of one or more of such colors.

The terms "formulation" and "composition" may be used interchangeably herein.

As used herein, "effective amount" refers to the minimal amount of a substance or agent, which is sufficient to achieve a desired effect. For example, an effective amount of an "ink vehicle" is the minimum amount required in order to create ink, which will meet the specified performance and characteristic standards. Additionally, the minimum amount of a "dye" would be the minimum amount, which can still achieve the specified performance and characteristic standards.

As used herein, "ink vehicle" refers to the vehicle in which a dye is placed to form ink. Ink vehicles are well known in the art, and a wide variety of ink vehicles may be used with the ink composition of the present invention. Such ink vehicles may include a mixture of a variety of different agents, including without limitation, surfactants, solvents, co-solvents, buffers, biocides, viscosity modifiers, surface-active agents, and water.

As used herein, "print media," "print surface," and "print substrate," and "substrate" may be used interchangeably herein, and refer to a surface to which ink is applied in order to form an image.

As used herein, "chroma" refers to the brightness of a color exhibited by the inkjet ink once printed on the substrate. See, R. W. G. Hunt, *The Reproduction of Colour*, $5^{th}$ Ed., Chap. 8.

As used herein, "optical density" refers to the fullness and intensity characteristics of an inkjet ink after application to a print medium. These visual effects are generally a measure of the concentration of ink at a given point on a print medium. Optical density may in one aspect be calculated as the negative log of the ratio of the light reflected off of the print media divided by the amount of light incident on the print media.

As used herein, "water fast," and "moisture fast," may be used interchangeably, and refer to the ability of an image to maintain its integrity, as measured by various parameters, such as edge acuity, optical density, chroma, etc., upon contact with water. Such terms are well known to those of ordinary skill in the art, and a variety of known methods may be used to measure and quantify the water fastness of an image.

As used herein, "smear" and "smudge" may be used interchangeably.

As used herein, "smear resistant," "smear resistance," "smudge resistant," and "smudge resistance," may be used interchangeably, and refer to the ability of an image to maintain its integrity as measured by various parameters, such as edge acuity, optical density, chroma, etc., upon contact with water and physical abrasion. Those of ordinary skill in the art will readily recognize the concept of smear resistant images, as well as a number of specific analytical methods for the determination and quantification thereof. One example of such analysis is more fully described in the examples below.

As used herein with reference to water soluble polymers, "interact," "interacting," and "interaction" refer to an action happening between the water soluble polymers which produces a water insoluble film therefrom. Notably, such interactions may include various mechanical, electrical, chemical, and electrochemical actions, such as the attraction or repulsion of positive and negative charges, bond forming chemical reactions, and frictional forces between adjacent molecules.

As used herein, "water insoluble" refers to the resistance of a substance to dissolution in water. It is to be understood that as used in the context of a protective polymeric film, the term "water insoluble" does not necessarily connote a 0% solubility of the film in water. Rather, the term extends to an amount of dissolution that is functionally sufficient to increase the smear resistance of the protected image to a selected degree, as opposed to an image of a similar ink jet ink that contains no such protective layer.

As used herein, "film" refers to a water insoluble coating or layer that has contact with ink jet ink in an image formed on a print substrate. Notably, such a coating or layer may be placed underneath the image, on top of (i.e. over the image), as well as intertwined, or admixed within or throughout the image. Moreover, such a film may be either continuous or fragmented, and may be specifically designed to have contact with only certain portions of the ink jet ink in an image as desired in order to achieve a specific effect or result. Furthermore, coatings or layer may be placed in a plurality of the above-recited positions with respect to the image.

As used herein, "overcoat," and "overcoat solution" may be used interchangeably, and refer to an anionic polymer or copolymer, or an aqueous solution containing such a polymer. No functional regard with respect to the placement of such polymer with respect to an ink jet ink image is to be given to the term "overcoat," rather, such a polymer may be placed as required in order to aid in formation of a protective water insoluble film as recited herein.

As used herein, "fixer," and "fixer solution" may be used interchangeably, and refer to a cationic polymer or copolymer, or an aqueous solution containing such a polymer. In one aspect, the polymers of the fixer interact with those of the overcoat to form a water insoluble film having contact with the ink in an ink jet ink image to improve the smear resistance thereof. In another aspect, the fixer may also aid in binding the colorant of the ink jet ink image to the printing substrate.

As used herein in connection with the location of interaction between water soluble polymers to form a substantially water insoluble film, "at" refers to one or more locations between an ink jet pen from which the polymers are discharged, and the print substrate. As such, "at" expressly includes interaction locations in the print substrate, on the print substrate, in the ink jet ink of the image formed on the substrate, on the ink jet ink image formed on the substrate. Moreover, "at" includes polymer interactions at locations in an environment above the image and substrate, such as in the air, with the proviso that interactions at such locations maintain the ability to aid in the formation of a protective film for the image as recited herein.

Concentrations, amounts, solubilities, and other numerical data may be recited herein in range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a concentration range of 1% w/w to 10% w/w should be interpreted to include not only the explicitly recited concentration limits of 1% and 10%, but also to include individual concentrations within that range, as well as sub ranges such as 2% w/w, 3.5%–4.5% w/w, 4.1% w/w, 5% w/w, 8% w/w, etc. This same principle applies to ranges reciting only one numerical value. Furthermore, such an interpretation should apply regardless of the breadth of the range or the characteristics being described.

Invention

The present invention encompasses smear resistant ink jet ink images and methods for the production thereof. Ink jet technology is increasingly being used to create a variety of images that are likely to be frequently handled and have a high likelihood of becoming smudged, such as bar codes, photographs, and other written documentation. As a result, the demand for smear resistant images continues to grow.

A smear resistant image made in accordance with the present invention will typically have various components.

First, the image will include an ink jet ink that is applied to a print substrate. A wide variety of ink jet inks are known. Generally, such inks include a colorant, such as a dye or a pigment, that is contained in an ink vehicle. A large number of specific dyes have been cataloged by M. Okawara, T. Kitao, T. Hirashima, M. Matsuoka in their publication, *Organic Colorants: A Handbook of Data for Electro-Optical Applications*, Elsevier, Amsterdam-Oxford-New York-Tokyo (1988), which is incorporated herein by reference. Additionally, a wide variety of specific pigment-type colorants are known. For example, those disclosed in Temple C. Patton Editor, *Pigment Handbook*. Volume 1 and 2, John Wiley and Sons, 1973.

In addition to the specific colorant or combination of colorants, an ink jet ink will include an ink vehicle in which the colorants are dispersed. Many well known ink vehicle components may be used in forming the images of the present invention, including without limitation, ingredients such as water, organic solvents, surface-active agents (surfactants), buffers, viscosity modifiers, biocides, surfactants, salts, and metal chelators. Notably, the specific type and amount of each ingredient may be determined by one of ordinary skill in the art, and may be selected depending on a specific result that is desired to be achieved.

Water may make up a large percentage of the overall ink vehicle. In one aspect, the water may be deionized water in an amount of from about 51% w/w to about 90% w/w of the ink composition. Various deionization techniques and states for water are known.

Organic solvents, or co-solvents may be included as a component of the ink vehicle, and are generally water-soluble solvents. In one aspect, the amount of organic solvent component may be from about 5% w/w to about 49% w/w of the ink formulation. One or more solvents may be used to achieve the amount specified above. Further, when a mixture of solvents is used, the combination may be included in a variety of ratios when necessary to achieve a specific result.

Examples of suitable solvents include without limitation: lactams, such as 2-pyrrolidone, N-methyl-pyrrolid-2-one (NMP), 1,3-dimethylimidazolid-2-one, and octyl-pyrrolidone; diols such as ethanediols, (e.g., 1-2-ethandiol), propanediols (e.g., 1,2-propanediol, 1,3-propanediol, 2-ethyl-2-hydroxy-methyl-1,3-propanediol, ethylhydroxy-propanediol (EHPD)), butanediols (e.g., 1,2-butanediol, 1,3-butanediol, 1,4-butanediol), pentanediols (e.g., 1,5-pentanediol), hexanediols (e.g., 1,2-hexanediol, 1,6-hexanediol, 2,5-hexanediol), heptanediols (e.g., 1,2-heptanediol, 1,7-heptanediol), octanediols (e.g., 1,2-octanediol, 1,8-octanediol); glycols, glycol ethers and thioglycol ethers, commonly employed in ink-jet inks, for example, polyalkylene glycols such as polyethylene glycols (e.g., diethylene glycol (DEG), triethylene glycol, tetraethylene glycol), polypropylene glycols (e.g., dipropylene glycol, tripropylene glycol, tetrapropylene glycol), polymeric glycols (e.g., PEG 200, PEG 300, PEG 400, PPG 400), liponic glycols (e.g. LEG-1 and LEG-7, available from Liponics), and thiodiglycol.

One or more surfactant ingredients may be included in the present ink formulations. In one aspect, the surfactant ingredient may be added in an amount of up to about 5% w/w of the ink composition. In one aspect, the surfactant may be present in an amount of from about 0.01 to about 4%. Such amounts may be achieved using a single surfactant ingredient, or a mixture of surfactant ingredients.

Generally, surfactants are used in order to lower the surface tension of the fluid and to increase the penetration of the ink into the print medium. A wide variety of surfactant classes may be used including without limitation, cationic, anionic, zwitterionic or non-ionic surfactants. One example of nonionic surfactants is secondary alcohol ethoxylates. Such compounds are commercially available, for example, Tergitol, Silwet, Surfynol, and Dowfax series, such as TERGITOL 15-S-5, TERGITOL 15-S-7 (Dow Chemical Co.), SILWET L77(Witco Chemicals), SURFYNOL 104E, SURFYNOL CT 111, SURFYNOL 440 (Air Products And Chemicals, Inc.), and DOWFAX 8390 (Dow Chemical Co.).

The ink vehicle of the present ink composition may optionally include up to about 5% w/w of a biocide. In one aspect, the biocide may be present in an amount of up to about 1 percent by weight of the ink composition. In a further aspect, the biocide may be present in an amount of up to 0.2% w/w of the ink composition. Such amounts may be the result of a single biocide ingredient, or a mixture of two or more biocides.

Any of the biocides commonly employed in inkjet inks, and known to those skilled in the art may be used in the practice of the present invention, such as NUOSEPT 95, available from Huls America (Piscataway, N.J.); PROXEL GXL, available from Avecia (Wilmington, Del.); and glutaraldehyde, available from Dow Chemical Company under the trade designation UCARCIDE 250. In one aspect, the biocide is PROXEL GXL.

In addition to the above-recited ingredients, the present inkjet ink composition may include a buffer agent. In one aspect, the buffer agent may be present in an amount of up to about 5 percent by weight of the ink composition. In another aspect, the buffer may be present in an amount of up to about 1% w/w of the ink composition. These amounts may be achieved using a single buffer agent, or a combination of buffer agents.

The buffers in the ink vehicle are primarily used to modulate pH. Such buffers can be organic-based biological buffers, or inorganic buffers. The specific type and amount of buffer may be readily selected by one of ordinary skill in the art in order to achieve a specific result. Examples of specific buffers which may be used include without limitation, Trizma Base, 4-morpholineethanesulfonic acid (MES), and 4-morpholinepropanesulfonic acid (MOPS), all available from Aldrich Chemical (Milwaukee, Wis.).

Metal chelating agents may be included in the ink vehicle of the present ink composition. In one aspect, the metal chelator may be present in an amount of up to about 2% w/w of the ink composition. In another aspect, the metal chelator may be present in an amount of up to about 1% w/w of the ink composition. In a further aspect, the metal chelator may be present in an amount of up to about 0.1% w/w of the ink composition. In yet another aspect, the metal chelator may be present in an amount of up to about 0.01% w/w of the ink composition. One or more metal chelators may be used to achieve these amounts.

A variety of metal chelators may be used in connection with the present invention as will be recognized by those skilled in the art. Examples of suitable metal chelators include without limitation, ethylenediaminetetraacetic acid (EDTA), diethylenetriaminepentaacetic acid (DTPA), trans-1,2-diaminocyclohexanetetraacetic acid (CDTA), (ethylenedioxy) diethylene dinitrilotetraacetic acid (EGTA), and other chelators that bind transition metal cations. In one aspect, the metal chelator may be EDTA.

In addition to the ink jet ink on the print substrate, the smear resistant images of the present invention include a water insoluble film having contact with the ink. Generally, the film includes a plurality of water soluble polymers which become water insoluble upon interaction with one another. Such an interaction may be the result of positive and negative charge attractive forces, chemical bonding, such as crosslinking, etc. Those of ordinary skill in the art will recognize a number of mechanisms for rendering specifically desired polymers water soluble, such as through the use of carboxylate salts.

A wide variety of water soluble polymers and copolymers may be interacted in order to form the protective water insoluble film of the image. However, in one aspect of the invention, the water soluble polymers may be a combination of at least one cationic polymer and at least one anionic polymer, with the desired film forming interaction occurring as a result of the charge attraction between the polymers.

As will be recognized, the amount of attractive force between cationic and anionic polymers is important in attaining an interaction that is sufficient to produce the water insoluble protective film used in the present invention. As a general matter, the more strongly attracted the cationic and anionic polymers are to one another, the greater the integrity of the film. To this end, in one aspect of the invention, the at least one cationic polymer may have a charge to mass ratio of at least about 5.0 meq/gram of polymer. In another aspect, the charge to mass ratio may be at least about 2.0 meq/gram of polymer Likewise, the at least one anionic polymer may have a charge to mass ratio of at least about 2.5 meq/gram of polymer. In another aspect, the charge to mass ratio may be at least about 1.0 meq/gram of polymer.

Numerous specific water soluble cationic polymers and copolymers may be used in combination with numerous water soluble anionic polymers and copolymers in order to achieve the desired interaction and precipitate the desired water insoluble protective film. Furthermore, the selection of specific polymers or copolymers for interaction may depend on a variety of factors pertinent to the end result desired, and such factors can be considered by one of ordinary skill in the art in selecting specific polymers.

However, in one aspect, the anionic polymer may be a copolymer having a molecular weight of less than about 12,000 that includes at least about 50% w/w of a hydrophobic monomer, from about 10% w/w to about 20% w/w of an acidic monomer, and about 30% w/w or less of an ethylene glycol containing monomer. In another aspect, the anionic polymer or copolymer may be an acrylic copolymer having a molecular weight of from about 5,000 to about 20,000, that includes from about 2.5% w/w to about 20% w/w of a crosslinking monomer, from about 26.5% w/w to about 70% w/w of a hydrophobic monomer, from about 3% w/w to about 40% w/w of a hydrophilic monomer, and from about 3% w/w to about 10% w/w of an acidic monomer. Furthermore, such copolymers may be either randomly structured or patterned.

Additionally, in one aspect of the invention, the cationic polymer may be a copolymer having a molecular weight of from about 5,000 to about 20,000 that includes from about 30% w/w to about 70% w/w of a 2-(N,N-dimethylamino) ethyl methacrylate monomer that is about 70% to about 100% neutralized with an acid, from about 25% w/w to about 50% w/w of a hydrophobic monomer, and up to about 20% of an ethyltriethyleneglycol methacrylate monomer. In a more detailed aspect, the 2-(N,N-dimethylamino) ethyl methacrylate monomer may be about 90% neutralized with an acid. In another aspect, such a cationic polymer may be a quaternary ammonium acrylate copolymer. In yet a further aspect, the 2-(N,N-dimethylamino)ethyl methacrylate monomer may be neutralized with either nitric acid, or para-toluene sulfonic acid. In another aspect of the invention, the cationic polymer may include about 30% w/w styrene, about 20% w/w ethyltriethyleneglycol methacrylate monomer, and about 50% w/w 2-(N,N-dimethylamino) ethyl methacrylate monomer that is neutralized with para-toluene sulfonic acid.

The cationic polymer may also be a quaternary ammonium acrylate polymer, and in some aspects may also contain the other cationic polymer constituents recited above. In one aspect, the quaternary ammonium acrylate polymer may be at least about 70% quaternized. In another aspect, it may be at least about 90% quaternized. A variety of quaternizing agents may be used, however, in one aspect, the quaternizing agent may be benzyl chloride.

The cationic polymer can also be a water soluble polyethyleneimine and/or a styrene maleimide. Specific examples of the polyethyleneimines include compounds such as the polymers marketed under the name Lupasol by BASF. Moreover, specific examples of styrene maleimides include those disclosed in U.S. patent application Ser. No. 09/781,782, filed on Mar. 15, 2000, under Hewlett Packard Docket No. 10002976, which is incorporated herein by reference in its entirety. A variety of specific styrene maleimides may also be obtained from Sartomer Company (Exton, Pa.). In some aspects, such polymers may have a charge to mass ratio of about 1 to 15 meq/gram of polymer. Moreover, in some aspects, such polymers may have a molecular weight of from about 500 to about 2000.

A wide variety of specific hydrophobic monomers are available for use in the creation of the above-recited polymers and copolymers. However, in one aspect, the hydrophobic monomer used may be a member selected from the group consisting essentially of: benzyl methacrylate, butyl methacrylate, methyl methacrylate, Zonyl® (a registered trademark of DuPont, Wilmington Del.) methacrylate (also known as perfluoroalkyl methacrylate), styrene, and mixtures thereof. In a more detailed aspect, the hydrophobic monomer may be zonyl methacrylate. In another aspect, the hydrophobic monomer may be styrene in an amount of about 30% w/w of the copolymer.

Additionally, several acidic monomers are known to those of ordinary skill in the art and may be selected for use in creating the above recited polymers and copolymers. However, in one aspect, the acidic monomer may be a member selected from the group consisting essentially of: acrylic acid, methacrylic acid, and mixtures thereof. In a more detailed aspect, the acidic monomer may be methacrylic acid.

The ethylene glycol containing monomer may be selected from various monomers that are acceptable for use in the present invention. In one aspect, the ethylene glycol containing monomer may be a member selected from the group consisting essentially of: ethyltriethyleneglycol methacrylate, 2-hydroxyethyl methacrylate, and mixtures thereof. In a more detailed aspect, the ethylene glycol containing monomer may be hydroxyethyl methacrylate.

A wide range of cross linking monomers will be recognized by those of ordinary skill in the art as acceptable for use in the present invention. Examples of such monomers include without limitation members of the group consisting essentially of: N-methylol acrylamide, isobutoxymethacrylamide, and mixtures thereof. In one aspect, the cross linking monomer may be N-methylol acrylamide.

Various hydrophilic monomers are suitable for use in making the present polymers and copolymers. However, in one aspect, the hydrophilic monomer may be a member selected from the group consisting essentially of: hydroxy ethylacrylate, 2-hydroxyethyl methacrylate, methoxypolyethyleneglycol methacrylate, ethyltriethyleneglycol methacrylate, and mixtures thereof. In another aspect, the hydrophilic monomer may be hydroxy ethylacrylate.

Notably, the polymers and copolymers recited herein may be produced by a number of typical polymeric reactions known to those of ordinary skill in the art. Further, while specific types and amounts of monomers have been recited, it is to be understood that the specific selection of a monomer from those enumerated, as well as others not specifically recited, may be made by one of ordinary skill in the art based, at least in part, on a number of criteria, such as the ink used to form the image, the type of substrate used, the other polymers to be interacted with, and the desired final characteristics of the image, among others. Such a determination, as well as the determination of specific amounts of each monomer to be used may be made by one of ordinary skill in the art using no more than routine experimentation. However, in a preferred aspect of the present invention, the cationic polymer may have a molecular weight of about 10,000, and includes 30% w/w styrene and 70% w/w 2-(N,N-dimethylamino)ethyl methacrylate, with about 90% of amine functions quaternized with benzyl chloride. Furthermore, in a preferred aspect of the invention, the anionic polymer may have a molecular weight of about 20,000, and include 25% w/w Styrene, 30% w/w benzyl methacrylate, 30% w/w ethyltriethyleneglycol methacrylate, and 15% w/w methylmethacrylate, and is 85% neutralized with KOH.

The present invention additionally encompasses a method of increasing the smear resistance of an image. In one aspect, such a method includes interacting a plurality of water soluble film forming polymers at the print substrate to form a water insoluble polymeric protective film having contact with the ink jet ink in the image. Specific examples of some of the acceptable film forming polymers are recited above. In one aspect of the invention, the polymers, and further, the ink may be delivered to the print substrate from separate ink jet ink pens. One specific example of such a method is disclosed, for example, in U.S. patent application Ser. No. 10/133,848 filed on Apr. 25, 2002, under Hewlett Packard Docket No. 10011934-1, which is incorporated herein by reference in its entirety.

By delivering the polymers, and further, the ink jet ink from separate ink jet pens, a number of advantages are attained, such as the ability to deliver a higher concentration of polymeric materials to be interacted at the print substrate. Thus, upon interaction, the water insoluble protective film is much more robust, has greater integrity, and is better able to protect the ink jet ink portion of the image from smearing. In the past, higher polymer concentrations were not possible due to degradation in pen reliability. Moreover, as the polymers are not mixed with the ink jet ink prior to delivery, there are no constraints set by the ingredients of the ink on the types of polymers that can be used. Further, the ingredients in the ink are not constrained by the types of polymers to be used in the film. As such, significantly more freedom is provided in formulating both the protective film portion of the image and the ink portion of the image.

In one aspect, the amount of water soluble polymer contained in a polymer solution to be jetted onto a print substrate from an ink jet ink pen may be at least about 5% w/w. In another aspect, the amount of polymer may be at least about 8% w/w. In yet another aspect, the amount may be at least about 10% w/w.

A number of trade offs between desirable visual characteristics and desirable performance characteristics have traditionally plagued the effort of increasing the smear resistance of an image. As a general matter, a standard trade off between smear resistance and optical density has existed. Specifically, in order to increase the optical density of an image, fluids are formulated to deliver more colorant to the print substrate, thus producing a high concentration of colorant in the image. As will be recognized, higher concentrations of colorant typically produce a higher incidence of smearing than lower concentrations of colorant. As a result, in order to improve smear resistance, fluids are formulated to deliver less colorant to the surface of the substrate, at the expense of the optical density of the image. As illustrated in the examples below, the images and methods of the present invention are able to achieve significant smear resistance without a corresponding sacrifice in optical density.

It is to be noted that the examples provided below are merely illustrative of specific embodiments for images and methods in accordance with invention disclosed herein, and no limitation thereon is to be inferred thereby.

EXAMPLES

A number of ink jet inks, fixer compositions, and overcoat compositions were prepared for use in making images to be tested for smear resistance. The ink jet inks are set forth in Table 1 below, the fixers are set forth in Table 2 below, and the overcoat formulations are set forth in Table 3 below. The dye concentrations of the inks were measured by UV-VIS to absorbance at a 1/10,000 dilution, and the pH of each ink was adjusted with NaOH or $HNO_3$ to about 8.5.

TABLE 1

Ink jet ink formulations used for image creation. Amounts of each ingredient are measured in percent by weight with the balance of the formulation being water.

| Ingredient | Cyan | Magenta | Yellow | Black |
|---|---|---|---|---|
| Glycerol | 7.5 | 7.5 | 7.5 | 7.5 |
| Buffer | 0.2 | 0.2 | 0.2 | 0.2 |
| Biocide | 0.2 | 0.2 | 0.2 | 0.2 |
| Alkyl Diol | 5 | 5 | 5 | 5 |
| Substituted Propane dial | 7.5 | 7.5 | 7.5 | 7.5 |
| Secondary Alcohol Ethoxylate | 0.5 | 0.5 | 0.5 | |
| Fluoro surfactant | 0.4 | 0.4 | 0.4 | |
| Substituted Acetylenic Diol | | | | 0.10 |
| ProJet Cyan 1 | 0.09 | | | |
| RB31 pacified | | | | 0.175 |
| Projet Fast Magenta 2 | | 0.104 | | |
| RR180 pacified | | 0.016 | | |
| RR 23 pacified | | | | |
| Projet Fast Yellow 2 | | | 0.074 | |
| DY132 | | | 0.100 | |

TABLE 2

Fixer Formulations used for image creation. Amounts of each ingredient are measured in percent by weight with the balance of the formulation being water.

| Ingredient | FIXER 1 | FIXER 2 |
|---|---|---|
| 2-Pyrrolidone | 5 | 4 |
| Tinolux BBS, 15% solid as is | 0.07 | 0.07 |
| Styrene maleimide (SMA) X1000i | | 3 |
| Lupasol FG, PEI | 5.0 | 3.5 |
| CaNitrate.4H20 | 2.5 | 3.5 |
| Polyethylene Glycol | | 6 |
| Alkyl Diol | 10 | 10 |
| Secondary Alcohol Ethoxylate | | 1.25 |
| Bioterg PAS-8S, as is | 0.20 | 2 |
| Secondary Alcohol Ethoxylate | 0.45 | |
| PH adjust NaOH/HNO3 | 4.5 | 4.5 |

TABLE 3

Overcoat Formulations. Amounts of each ingredient are measured in percent by weight with the balance of the formulation being water.

| Ingredient | OVERCOAT 1 | OVERCOAT 2 |
|---|---|---|
| Surfynol 465 | 0.075 | 0.075 |
| Anionic Polymer (Styrene/BMA/ETEGMA/MMA 25/30/30/15 wt ratios, 85% neutralized with KOH, MW of 20,000). | 10.0 | 8.0 |
| 2-Pyrrolidone | 13 | 13 |
| LEG-1 | 3 | 3 |
| Tinolux BBS, 15% solid as is | 0.07 | 0.07 |
| PH adjust NaOH/HNO3 | 9.0 | 9.0 |

A print substrate consisting of Weyerhauser First Choice plain paper media (WFCH), was selected for image printing. The optical density of the media without an image was recorded to be 0.05. Samples images were printed using a 3 pen ink jet ink printer as recited above, and consisted of a series of colored bars with white spaces in between. Control images were formed using the ink jet inks, a fixer from Table 2, and the overcoat vehicle only (i.e. no cationic polymer). Other comparative images were formed using a combination of the ink jet inks and fixer only, as well as the ink jet inks and the overcoat only. Additionally, images were formed that included the ink jet inks, and a combination of the fixer and overcoat in accordance with the present invention.

The image samples were allowed to dry for about 24 hours, and then were fastened to a 45 degree incline. A constant quantity of water was dispensed from a micropipette to form a stream of water passing over the colored bar image. Then, an index finger covered in latex (latex glove) was pulled down the drip line. Spectral analysis was performed on the images using an optical densitometer by McBeth model RD917 to assess the change in optical density of the white spaces between the printed lines, in view of the optical density of the printed lines themselves.

The testing results for each ink were then averaged and correlated, and the performance charted as shown in FIG. 1. As can be seen, the control sample which includes the ink jet ink, a fixer, and overcoat vehicle, and further, the comparative samples that include fixer only, display the typical trade-off between smear resistance and optical density. That is, the steep slope of the lines for these testing results show that as the optical density of the printed lines increases, that the incidence of smearing significantly increases. By contrast, the gentle slope of the lines representing the test results for images having a combination of the ink jet ink, the fixer, and the overcoat, show that as the optical density of the printed lines increases, the incidence of smearing does not significantly increase. Thus these results indicate that the combination of the cationic polymer in the fixer and the anionic polymer in the overcoat interact to form a film having contact with the ink jet ink portion of an image and substantially increase the smear resistance thereof.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A smear resistant ink jet image on a print substrate comprising:

an image made with an ink jet ink; and a water insoluble protective film having contact with the ink jet ink in the image, said film comprising a combination of water soluble film forming polymers that become water insoluble upon interaction with one another, wherein at least one polymer is anionic and at least one polymer is cationic, and the interaction occurs as a result of charge attraction between the polymers, and wherein the at least one anionic polymer has a charge to mass ratio of at least about 1.0 to 2.5 meq/gram of polymer.

2. The image of claim 1, wherein the at least one cationic polymer has a mass to charge ratio of at least about 2.0 to 5.0 meq/gram of polymer.

3. The image of claim 1, wherein the at least one anionic polymer is a copolymer having a molecular weight of less than about 12,000 and includes at least about 50% w/w of a hydrophobic monomer, from about 10% w/w to about 20% w/w of an acidic monomer, and about 30% w/w or less of an ethylene glycol containing monomer.

4. The image of claim 3, wherein the hydrophobic monomer is a member selected from the group consisting essentially of: benzyl methacrylate, butyl methacrylate, methyl methacrylate, zonyl methacrylate, styrene, and mixtures thereof.

5. The image of claim 3, wherein the acidic monomer is a member selected from the group consisting essentially of: acrylic acid, methacrylic acid, and mixtures thereof.

6. The image of claim 3, wherein the copolymer is randomly structured.

7. The image of claim 3, wherein the ethylene glycol containing monomer is a member selected from the group consisting essentially of: ethyltriethyleneglycol methacrylate, 2-hydroxyethyl methacrylate, and mixtures thereof.

8. The image of claim 1, wherein the at least one anionic polymer is an acrylic copolymer having a molecular weight of from about 5,000 to about 20,000, and includes from about 2.5% w/w to about 20% w/w of a crosslinking monomer, from about 26.5% w/w to about 70% w/w of a hydrophobic monomer, from about 3% w/w to about 40% w/w of a hydrophilic monomer, and from about 3% w/w to about 10% w/w of an acidic monomer.

9. The image of claim 8, wherein the hydrophobic monomer is a member selected from the group consisting essentially of: benzyl methacrylate, butyl methacrylate, methyl methacrylate, zonyl methacrylate, styrene, and mixtures thereof.

10. The image of claim 8, wherein the acidic monomer is a member selected from the group consisting essentially of: acrylic acid, methacrylic acid, and mixtures thereof.

11. The image of claim 8, wherein the crosslinking monomer is a member selected from the group consisting essentially of: N-methylol acrylamide, isobutoxymethacrylamide, and mixtures thereof.

12. The image of claim 8, wherein the hydrophilic monomer is a member selected from the group consisting essentially of: hydroxy ethylacrylate, 2-hydroxyethyl methacrylate, methoxypolyethyleneglycol methacrylate, ethyltriethyleneglycol methacrylate, and mixtures thereof.

13. The image of claim 8, wherein the copolymer is randomly structured.

14. The image of claim 1, wherein the cationic polymer has a molecular weight of about 10,000, and includes 30% w/w styrene and 70 w/w %-(N,N-dimethylamino)ethyl methacrylate, and is 90% quaternized with benzyl chloride.

15. The image of claim 1, wherein the at least one cationic polymer is a copolymer having a molecular weight of from about 5,000 to about 20,000 and includes from about 30% w/w to about 70% w/w of a 2-(N,N-dimethylamino) ethyl methacrylate monomer that is about 70% to about 100% neutralized with an acid, from about 25% w/w to about 50% w/w of a hydrophobic monomer, and up to about 20% of an ethyltriethyleneglycol methacrylate monomer.

16. The image of claim 15, wherein the hydrophobic monomer is a member selected from the group consisting essentially of: benzyl methacrylate, butyl methacrylate, methyl methacrylate, zonyl methacrylate, styrene, and mixtures thereof.

17. The image of claim 15, wherein the copolymer is randomly structured.

18. The image of claim 15, wherein the 2-(N,N-dimethylamino)ethyl methacrylate monomer is neutralized with either nitric acid, or para-toluene sulfonic acid.

19. The image of claim 15, wherein the at least one cationic polymer is a quaternary ammonium acrylate copolymer.

20. The image of claim 19, wherein the quaternary ammonium acrylate polymer is at least about 90% quaternized with benzyl chloride.

21. The image of claim 19, wherein the hydrophobic monomer is a member selected from the group consisting essentially of: benzyl methacrylate, butyl methacrylate, methyl methacrylate, zonyl methacrylate, styrene, and mixtures thereof.

22. The image of claim 21, wherein the hydrophobic monomer is styrene in an amount of about 30% w/w of the polymer.

23. The image of claim 19, wherein the copolymer is randomly structured.

24. The image of claim 1, wherein the at least one anionic polymer has a molecular weight of about 20,000, is 25% w/w Styrene, 30% w/w benzyl methacrylate, 30% w/w ethyltriethyleneglycol methacrylate, and 15% w/w methylmethacrylate, and is 85% neutralized with KOH.

25. The image of claim 1, wherein the at least one cationic polymer has a molecular weight of about 10,000, and includes 30% w/w styrene and 70 w/w % 2-(N,N-dimethylamino)ethyl methacrylate, with about 90% of amine functions quaternized with benzyl chloride.

26. A method of improving smear resistance of an ink jet image on a print substrate, comprising the steps of:

a) jetting a first water soluble film forming polymer at the print substrate;

b) separately jetting a second water soluble film forming polymer at the print substrate;

c) jetting an ink jet ink at the print substrate; and d) interacting the first and second water soluble film forming polymers at the print substrate to form a water insoluble polymeric protective film having contact with ink jet ink in the image.

27. The method of claim 26, wherein the water soluble film forming polymers are presented in a carboxylate salt form.

28. The method of claim 26, wherein the film forming polymers are interacted at the print substrate prior to formation of the ink jet ink image.

29. The method of claim 26, wherein the film forming polymers are interacted at the print substrate during formation of the ink jet ink image.

30. The method of claim 26, wherein the film forming polymers are interacted at the print substrate after formation of the ink jet ink image.

31. The method of claim 26, wherein the film forming polymers are interacted at the print substrate before, during, and after formation of the ink jet ink image.

32. The method of claim 26, wherein at least one polymer is anionic and at least one polymer is cationic, and interaction occurs as a result of charge attraction between the polymers.

33. The method of claim 32, wherein the at least one anionic polymer has a charge to mass ratio of at least about 1.0 to 2.5 meq/gram of polymer.

34. The method of claim 32, wherein the at least one cationic polymer has a charge to mass ratio of at least about 2.0 to 5.0 meq/gram of polymer.

35. The method of claim 32, wherein the at least one anionic polymer is a copolymer having a molecular weight of less than about 12,000 and includes at least about 50% w/w of a hydrophobic monomer, from about 10% w/w to about 20% w/w of an acidic monomer, and about 30% w/w or less of an ethylene glycol containing monomer.

36. The method of claim 35, wherein the hydrophobic monomer is a member selected from the group consisting essentially of: benzyl methacrylate, butyl methacrylate, methyl methacrylate, zonyl methacrylate, styrene, and mixtures thereof.

37. The method of claim 35, wherein the acidic monomer is a member selected from the group consisting essentially of: acrylic acid, methacrylic acid, and mixtures thereof.

38. The method of claim 35, wherein the copolymer is randomly structured.

39. The method of claim 35, wherein the anionic polymer has a molecular weight of about 20,000, and includes 25% w/w Styrene, 30% w/w benzyl methacrylate, 30% w/w ethyltriethyleneglycol methacrylate, and 15% w/w methylmethacrylate, and is 85% neutralized with KOH.

40. The method of claim 35, wherein the ethylene glycol containing monomer is a member selected from the group consisting essentially of: ethyltriethyleneglycol methacrylate, 2-hydroxyethyl methacrylate, and mixtures thereof.

41. The method of claim 35, wherein the crosslinking monomer is a member selected from the group consisting essentially of: N-methylol acrylamide, isobomylmethacrylateisobutoxymethacrylamide, and mixtures thereof.

42. The method of claim 35, wherein the hydrophilic monomer is a member selected from the group consisting essentially of: hydroxy ethylacrylate, 2-hydroxyethyl methacrylate, methoxypolyethyleneglycol methacrylate, ethyltriethyleneglycol methacrylate, and mixtures thereof.

43. The method of claim 32, wherein the at least one anionic polymer is an acrylic copolymer having a molecular weight of from about 5,000 to about 20,000, and includes from about 2.5% w/w to about 20% w/w of a crosslinking monomer, from about 26.5% w/w to about 70% w/w of a hydrophobic monomer, from about 3% w/w to about 40% w/w of a hydrophilic monomer, and from about 3% w/w to about 10% w/w of an acidic monomer.

44. The method of claim 43, wherein the hydrophobic monomer is a member selected from the group consisting essentially of: benzyl methacrylate, butyl methacrylate, methyl methacrylate, zonyl methacrylate, styrene, and mixtures thereof.

45. The method of claim 43, wherein the acidic monomer is a member selected from the group consisting essentially of: acrylic acid, methacrylic acid, and mixtures thereof.

46. The method of claim 43, wherein the copolymer is randomly structured.

47. The method of claim 43, wherein the anionic polymer has a molecular weight of about 20,000, and includes 25% w/w Styrene, 30% w/w benzyl methacrylate, 30% w/w ethyltriethyleneglycol methacrylate, and 15% w/w methylmethacrylate, and is 85% neutralized with KOH.

48. The method of claim 32, wherein the at least one cationic polymer is a copolymer having a molecular weight of from about 5,000 to about 20,000 and includes from about 30% w/w to about 70% w/w of a 2-(N,N-dimethylamiono) ethyl methacrylate monomer that is about 70% to about 100% neutralized with an acid, from about 25% w/w to about 50% w/w of a hydrophobic monomer, and up to about 20% of an ethyltriethyleneglycol methacrylate monomer.

49. The method of claim 48, wherein the hydrophobic monomer is a member selected from the group consisting essentially of: benzyl methacrylate, butyl methacrylate, methyl methacrylate, zonyl methacrylate, styrene, and mixtures thereof.

50. The method of claim 48, wherein the copolymer is randomly structured.

51. The method of claim 48, wherein the 2-(N,N-dimethylamiono)ethyl methacrylate monomer is neutralized with either nitric acid, or para-toluene sulfonic acid.

52. The method of claim 48, wherein the at least one cationic polymer is a quaternary ammonium acrylate polymer.

53. The method of claim 52, wherein the quaternary ammonium acrylate polymer is at least about 90% quaternized with benzyl chloride.

54. The method of claim 52, wherein the hydrophobic monomer is a member selected from the group consisting essentially of: benzyl methacrylate, butyl methacrylate, methyl methacrylate, zonyl methacrylate, styrene, and mixtures thereof.

55. The method of claim 52, wherein the hydrophobic monomer is styrene in an amount of about 30% w/w of the polymer.

56. The method of claim 52, wherein the copolymer is randomly structured.

57. The method of claim 48, wherein the at least one cationic polymer has a molecular weight of about 10,000, and includes 30% w/w % styrene and 70 w/w % 2-(N,N-dimethylamino)ethyl methacrylate, with about 90% of amine functions quaternized with benzyl chloride.

58. A smear resistant ink jet image on a print substrate comprising:

an image made with an ink jet ink; and a water insoluble protective film having contact with the ink jet ink in the image, said film comprising a combination of water soluble film forming polymers that become water insoluble upon interaction with one another, wherein at least one polymer is anionic and at least one polymer is cationic, and the interaction occurs as a result of charge attraction between the polymers, and wherein the at least one cationic polymer has a mass to charge ratio of at least about 2.0 to 5.0 meq/gram of polymer.

59. The image of claim 58, wherein the at least one anionic polymer has a charge to mass ratio of at least about 1.0 to 2.5 meq/gram of polymer.

60. The image of claim 58, wherein the at least one anionic polymer is a copolymer having a molecular weight of less than about 12,000 and includes at least about 50% w/w of a hydrophobic monomer, from about 10% w/w to about 20% w/w of an acidic monomer, and about 30% w/w or less of an ethylene glycol containing monomer.

61. The image of claim 58, wherein the at least one anionic polymer is an acrylic copolymer having a molecular weight of from about 5,000 to about 20,000, and includes from about 2.5% w/w to about 20% w/w of a crosslinking monomer, from about 26.5% w/w to about 70% w/w of a hydrophobic monomer, from about 3% w/w to about 40% w/w of a hydrophilic monomer, and from about 3% w/w to about 10% w/w of an acidic monomer.

62. The image of claim 58, wherein the cationic polymer has a molecular weight of about 10,000, and includes 30% w/w styrene and 70 w/w % -(N,N-dimethylamino)ethyl methacrylate, and is 90% quaternized with benzyl chloride.

63. The image of claim 58, wherein the at least one cationic polymer is a copolymer having a molecular weight of from about 5,000 to about 20,000 and includes from about 30% w/w to about 70% w/w of a 2-(N,N-dimethylamino) ethyl methacrylate monomer that is about 70% to about 100% neutralized with an acid, from about 25% w/w to about 50% w/w of a hydrophobic monomer, and up to about 20% of an ethyltriethyleneglycol methacrylate monomer.

64. The image of claim 58, wherein the at least one anionic polymer has a molecular weight of about 20,000, is 25% w/w Styrene, 30% w/w benzyl methacrylate, 30% w/w ethyltriethyleneglycol methacrylate, and 15% w/w methylmethacrylate, and is 85% neutralized with KOH.

65. The image of claim 58, wherein the at least one cationic polymer has a molecular weight of about 10,000, and includes 30% w/w styrene and 70 w/w % 2-(N,N-dimethylamino)ethyl methacrylate, with about 90% of amine functions quaternized with benzyl chloride.

* * * * *

UNITED STATES PATENT AND TRADEMARK OFFICE

CERTIFICATE OF CORRECTION

PATENT NO. : 6,866,381 B2
DATED : March 15, 2005
INVENTOR(S) : Kelly-Rowley et al.

It is certified that error appears in the above-identified patent and that said Letters Patent is hereby corrected as shown below:

Column 13,
Line 63, delete “Styrene,” insert -- styrene, --.

Column 14,
Line 1, delete “70 w/w %” insert -- 70% w/w --.

Column 15,
Line 29, delete “Styrene,” insert -- styrene, --.

Column 16,
Line 5, delete “30% w/w %” insert -- 30% w/w --.
Line 5, delete “70 w/w %” insert -- 70% w/w --.
Line 42, delete “70 w/w %-(N,N-dimethylamino)ethyl” insert -- 70% w/w 2-(N,N-dimethylamino)ethyl --.

Signed and Sealed this

Twentieth Day of December, 2005

JON W. DUDAS
*Director of the United States Patent and Trademark Office*